US005562548A

United States Patent [19]

Pinch et al.

[11] Patent Number: 5,562,548

[45] Date of Patent: Oct. 8, 1996

[54] CONVERTIBLE CHILD SWING

[75] Inventors: Daniel R. Pinch, Hope; Dennis M. Turner, Scipio, both of Ind.

[73] Assignee: Cosco, Inc., Columbus, Ind.

[21] Appl. No.: 334,597

[22] Filed: Nov. 4, 1994

[51] Int. Cl.[6] ..... A63G 9/16

[52] U.S. Cl. ..... 472/119; 472/118; 297/256.12; 297/256.16; 297/344.21

[58] Field of Search ..... 472/118, 119; 5/105, 106, 107; 297/130, 256.16, 256.12, 344.21, 344.22

[56] References Cited

U.S. PATENT DOCUMENTS

| | | |
|---|---|---|
| D. 325,132 | 4/1992 | Cone . |
| 2,975,866 | 3/1961 | Worthington . |
| 3,459,423 | 8/1969 | Meade . |
| 3,526,400 | 9/1970 | Carpenter et al. . |
| 3,794,317 | 2/1974 | Barrett . |
| 4,165,872 | 8/1979 | Saint . |
| 4,323,233 | 4/1982 | Gebhard . |
| 4,452,446 | 6/1984 | Saint . |
| 4,807,872 | 2/1989 | Spilman et al. . |
| 4,998,307 | 3/1991 | Cone . |
| 5,083,773 | 1/1992 | Saint . |

*Primary Examiner*—Kien T. Nguyen
*Attorney, Agent, or Firm*—Barnes & Thornburg

[57] ABSTRACT

A child swing including a support stand, a swing frame mounted on the support stand for reciprocating swinging movement along a swing arc in a forward swing direction and an opposite rearward swing direction, a base pivotably coupled to the swing frame for angular movement about a pivot axis between a forward-facing position facing in the forward swing direction and a side-facing position facing in a side direction extending at an angle to the forward swing direction, and a child seat coupled to the base to pivot therewith relative to the swing frame.

19 Claims, 3 Drawing Sheets

CONVERTIBLE CHILD SWING

BACKGROUND AND SUMMARY OF THE INVENTION

The present invention relates to swings for children, and particularly to a child swing including a child seat that is convertible between a chair configuration and a cradle configuration. More particularly, the present invention relates to a child swing having a removable child seat that can also function as a car seat or car bed.

Child swings typically include child seats supported for movement on a swingable frame. Child swings are disclosed, for example, in U.S. Pat. Nos. 2,975,866; 4,165,872; 4,323,233; 5,083,773; 4,452,446; 4,807,872; and 4,165,872.

What is needed is a multi-position child swing that is more versatile than a traditional child swing. Consumers would appreciate a child swing having a multi-position child seat that could be converted easily at the option of the consumer from a chair to a cradle. Consumers would welcome a versatile child swing seat that could be removed easily from a swing frame in the child swing and used as a car seat, a car bed, or an infant-carrying device.

According to the present invention, a child swing includes a support stand and a swing frame mounted on the support stand for reciprocating swinging movement along a swing arc in a forward swing direction and an opposite rearward swing direction. The child swing further includes a base pivotably coupled to the swing frame for angular movement about a pivot axis between a forward-facing position facing in the forward swing direction and a side-facing position facing in a side direction which extends at an angle to the forward swing direction. A child seat is coupled to the base to pivot therewith relative to the swing frame.

In preferred embodiments, the child seat includes a generally rigid shell assembly for receiving a child. The shell assembly includes a lower shell portion for receiving the lower body of a child seated therein and an upper shell portion for receiving the head and upper body of a child seated therein. The upper shell portion is pivotably coupled to the lower shell portion to permit a caregiver to change the configuration of the shell assembly from a "cradle" configuration wherein the upper and lower shell portions are aligned in a substantially planar configuration and a "chair" configuration in which the upper shell portion is aligned at an angle relative to the lower shell portion. Illustratively, the lower shell portion is mounted to the pivotable base included in the child swing so as to permit a caregiver to move the upper shell portion relative to both the base and the lower shell portion. This feature enables the caregiver to convert the child seat between a chair configuration and a cradle configuration while the child seat is mounted in a fixed position on the pivotable base included in the child swing.

Illustratively, the support stand includes a laterally extending swing motor housing containing means for swinging the swing frame along the swing arc and four support legs holding the swing motor housing in an elevated position above the ground. The swing frame includes a first swing arm having an upper portion coupled to the swing motor housing and a lower portion positioned to lie underneath the pivotable base. The swing frame also includes a second swing arm having an upper portion coupled to the swing motor housing and a lower portion positioned to lie underneath the pivotable base and in spaced-apart relation to the lower portion of the first swing arm. A base cross bar is positioned to lie underneath the pivotable base and interconnect the lower portions of the first and second swing arms. A vertical pivot post is mounted on the base cross bar and the base is mounted on that pivot post for pivotable movement between the forward-facing position and the side-facing position.

In use, the child seat mounted on the pivotable base will typically be converted by the caregiver to a chair configuration whenever the base is arranged to lie in its forward-facing position. This arrangement will allow the child swing to function in a manner familiar to many caregivers since it will provide a forward-facing chair that swings back and forth along a swing arc in forward and rearward swing directions. A child seated in a child seat converted to the chair configuration will face in the forward swing direction during swinging of the swing frame carrying the pivotable base and the child seat.

Alternatively, the caregiver can elect to pivot the base about its pivot post through a 90° angle relative to the swing frame to cause a front edge of the base to face in a sideways direction instead of in a forward direction. At this stage, it is expected that the caregiver will typically reconfigure the child seat to function as a cradle by pivoting the upper shell portion downwardly relative to the lower shell portion so that the upper and lower shell portions are aligned in a substantially planar configuration to provide a cradle-style child seat. While the child seat is in this cradle configuration, the child received in the cradle will be laying down so that the child's head extends toward one of the two sides of the swing seat and the child's feet extend toward the other of the two sides of the swing seat so that a left side of the cradle faces in the forward swing direction and a right side of the cradle faces in a rearward swing direction. This provides a comfortable position for a child during swinging of the swing frame with the child seat in the cradle configuration.

Also in preferred embodiments, the base includes a platform supporting the lower shell portion of the child seat and a latch assembly coupled to the platform for movement between a latching position engaging the child seat to retain the child seat on the platform and a releasing position disengaging the child seat to release the child seat from the platform. Illustratively, a pair of such latch assemblies are mounted on the platform and arranged in spaced-apart relation so that one latch assembly is movable relative to the platform to engage a right side of the lower shell portion and another latch assembly is movable relative to the platform to engage a left side of the lower shell portion. Detent mechanisms are provided on the platform to retain each latch assembly in either its latching position or its releasing position at the option of the caregiver. Such a feature helps to hold the child seat in a fixed position on the platform during swinging motion of the child seat in both the chair and cradle configurations of the child seat.

Illustratively, the child seat is constructed so that it can be removed from its mounted position on the platform by manual operation of the latch assemblies. This enables a caregiver to remove the child seat so that it can be used apart from the child swing as a car seat, a car bed, or other infant-carrying or child-seating device.

Additional objects, features, and advantages of the invention will be apparent to those skilled in the art upon consideration of the following detailed description of a preferred embodiment exemplifying the best mode of carrying out the invention as presently perceived.

BRIEF DESCRIPTION OF THE DRAWINGS

The detailed description refers to the accompanying figures in which.

DETAILED DESCRIPTION OF THE DRAWINGS

Figure 1:
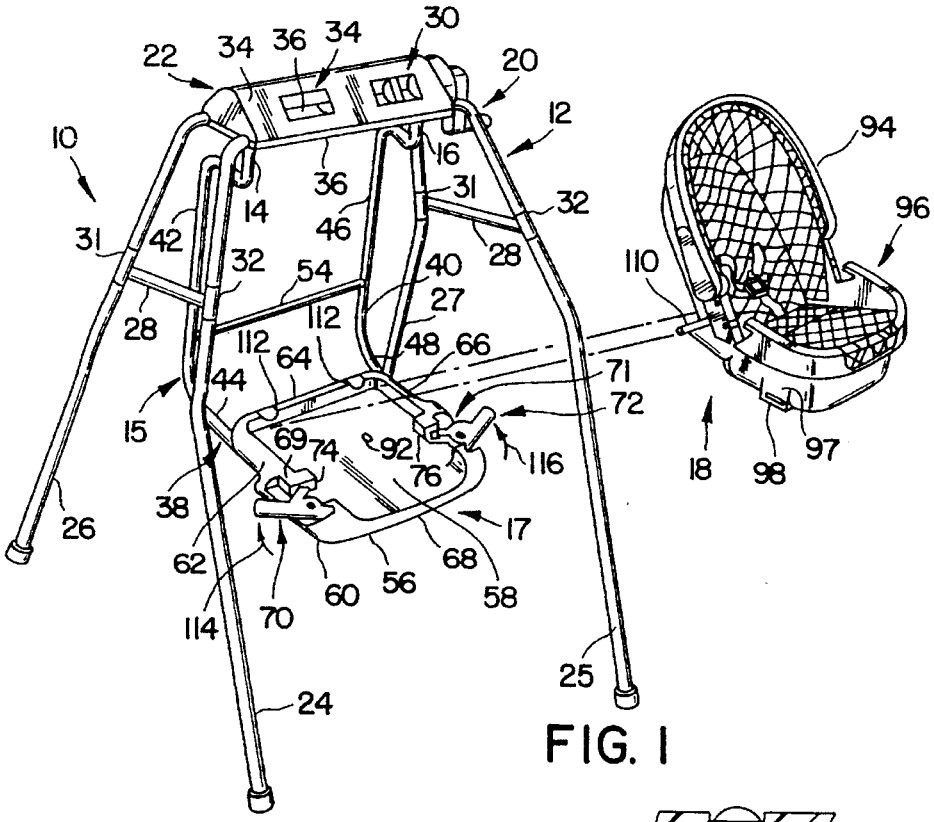
FIG. 1 is a perspective view of a child swing in accordance with the present invention showing a four-legged support stand, a tubular swing frame coupled to the support stand for swinging movement thereon, a rectangular base pivotably mounted to the swinging frame, and a multi-position child seat configured to be mounted and latched in place on the pivotable base and converted to a chair configuration wherein an upper shell portion of the child seat is fixed to lie at an angle to a lower shell portion of the child seat.

A child swing 10 in accordance with the present invention is show in FIG. 1. The child swing 10 is set up in a ready-to-use position and includes a support stand 12, a pair of swinging hanger arms 14, 16, a swing frame 15 coupled to hanger arms 14, 16, a pivotable base 17 mounted on swing frame 15, child seat 18, and a crank handle 20. The support stand 12 includes a swing motor housing 22, front legs 24, 25 mounted to the front edge of the swing motor housing 12, rear legs 26, 27 mounted to the rear edge of the swing motor housing 12, and a pair of removable leg braces 28.

The crank handle 20 can be turned to wind up a spring motor (not shown) mounted in the swing motor housing 22. Reference is hereby made to U.S. Pat. No. 5,378,196 issued Jan. 3, 1995, to Pinch et al., which patent is incorporated by reference herein, for a description of a swing motor suitable for use in child swing 10. The swing framed 15, base 17, and child seat 18 swing automatically back and forth along a smooth swing arc under the swing motor housing 12 as the spring motor unwinds. A run-time indicator 30 is provided in swing motor housing 12 to make it easy for nearby persons to monitor how long the spring-powered child swing 10 is expected to continue to run before the spring motor fully unwinds and ceases to import pendulum motion to the swing frame 15 through hanger arm 16.

Each leg brace 28 includes, for example, on one end a snap-on clamp 31 formed to snap onto the rear leg and on the other end a snap-on clamp 32 formed to snap onto the front leg. It will be understood that many kinds of braces could be used to hold the front and rear legs 25, 25, 26, and 27 in the locked, spread position shown in FIG. 1.

The front side of swing motor housing 12 is also formed to provide a carrying handle 34 adjacent to the run-time indicator 30 to make it easy for a person to grip and carry the child swing 10. An elongated aperture 36 extends along the back side of carrying handle 34 to receive the fingers of a person gripping the carrying handle 34. Conveniently, another carrying handle (not shown) and finger-receiving aperture (not shown) are formed along the back side of the swing motor housing 12 to make it easy for a person approaching the child swing 10 from the rear to grip and lift it.

Housing 22 is preferably a clamshell design and includes a top half shell 34 and a complementary bottom half shell 36. Advantageously, in this clamshell design, the swing motor components (not shown) are fully encased in housing 22 and therefore not easily accessed by a child riding in child swing 10 or standing nearby child swing 10.

Figure 8:
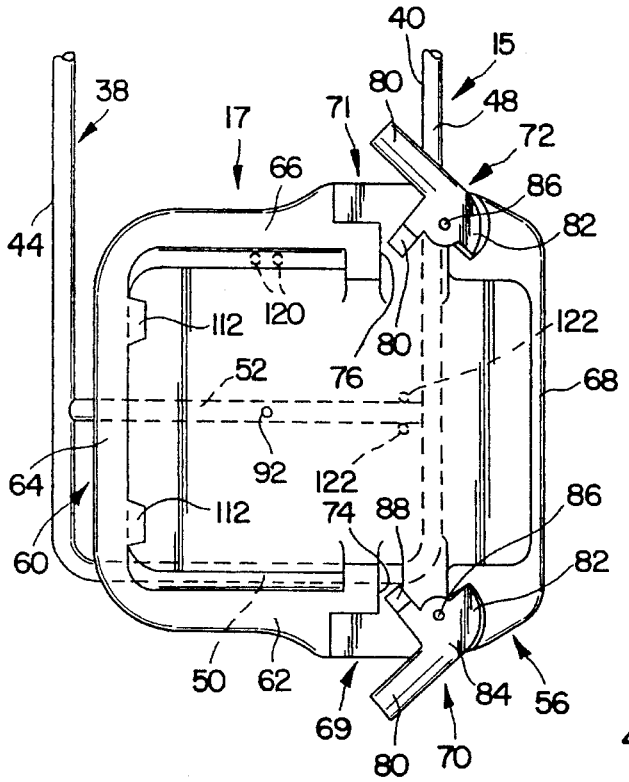
FIG. 8 is a view similar to FIGS. 2 and 7 showing the position of the pivotable base relative to the swing frame once the pivotable base has been pivoted through a 90° angle about the pivot post from its forward-facing position shown in FIGS. 2 and 4–6 to its side-facing direction.
Figure 9:
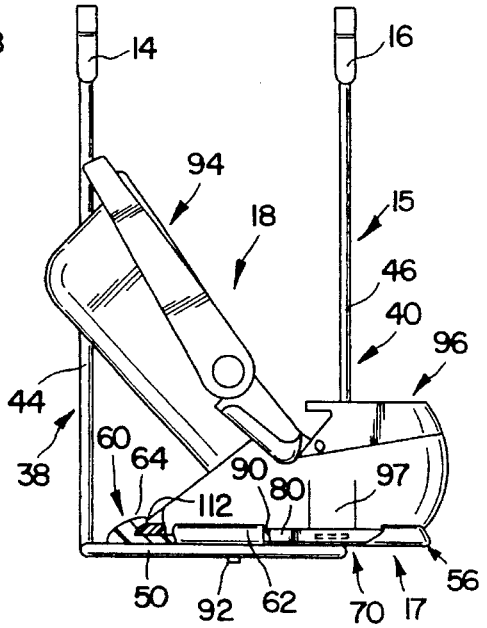
FIG. 9 is a view showing the child seat in its chair configuration upon arrival of the pivotable base at its side-facing position shown in plain view in FIG. 8.
Figure 7:
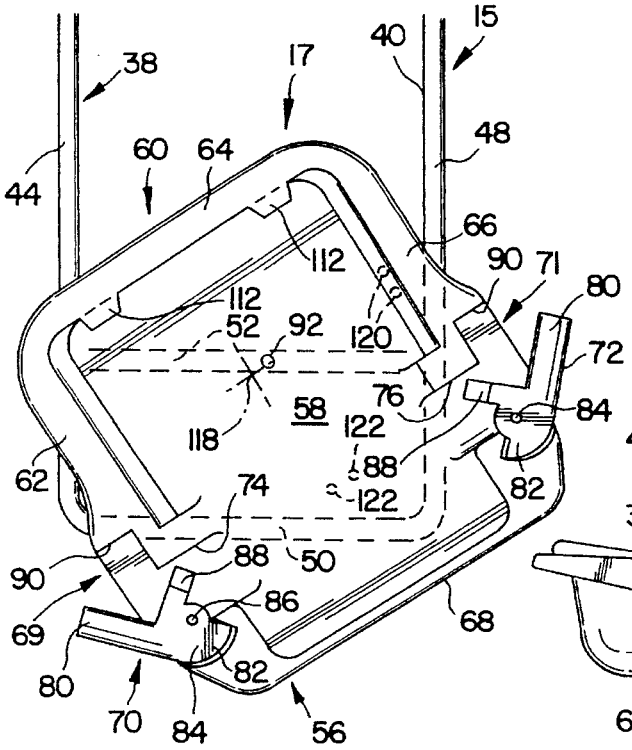
FIG. 7 is a view similar to FIG. 2 showing pivoting movement of the pivotable base about the pivot post mounted on the swing frame cross bar provided underneath the base and showing that the center of gravity of the combined child seat and base is offset from the center of rotation of the combined child seat and base established by the pivot post mounted on the cross bar under the base.
Figure 10:
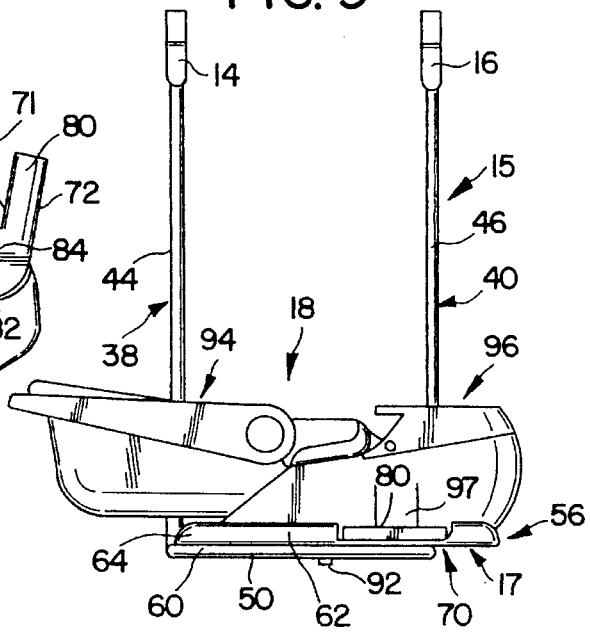
FIG. 10 is a view similar to FIG. 9 showing the child seat in its cradle configuration after a caregiver has elected to pivot the upper shell portion downwardly into alignment with the adjacent lower shell portion so that the upper shell portion extends toward one side of child swing and the lower shell portion extends toward the other side of the child swing.

Swing frame 15 includes an elbow-shaped first side arm 38 and an elbow-shaped second side arm 40 arranged to lie in spaced-apart relation as show in FIGS. 1, 9, and 10. First side arm 38 includes an upper portion 42 coupled to left hanger arm 14 as shown in FIG. 1 and a lower portion 44 positioned to lie under pivotable base 17 as shown, for example, in FIG. 2. Likewise, second side arm 40 includes an upper portion 46 coupled to right hanger arm 16 and a lower portion 48 positioned to lie under pivotable base 17. Swing frame 15 further includes a bight portion 50 interconnecting distal ends of first and second side arms 38, 40 as shown in FIGS. 7 and 8.

Figure 2:
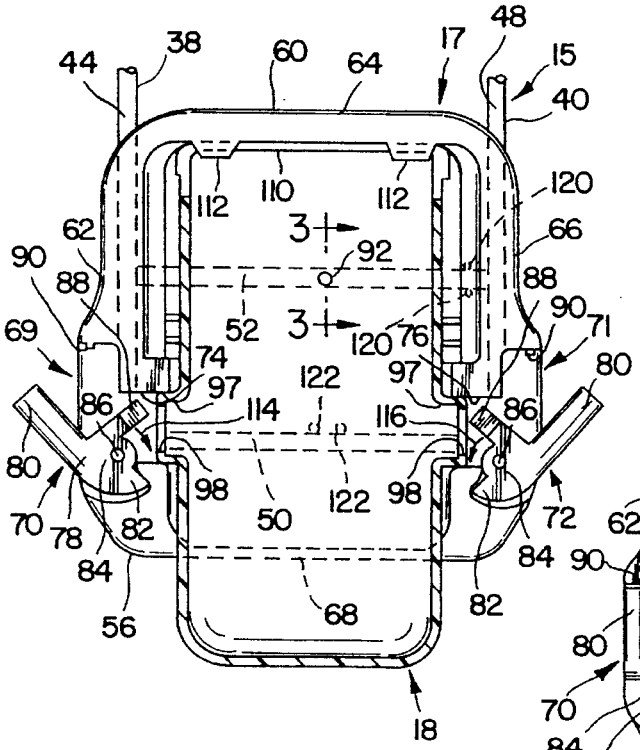
FIG. 2 is a plan view of the pivotable base of FIG. 1 with the child seat mounted thereon (and shown in section) showing two pivotable latch assemblies moved in opposite directions to disengage the car seat and lie in their child seat-releasing positions.
Figure 5:
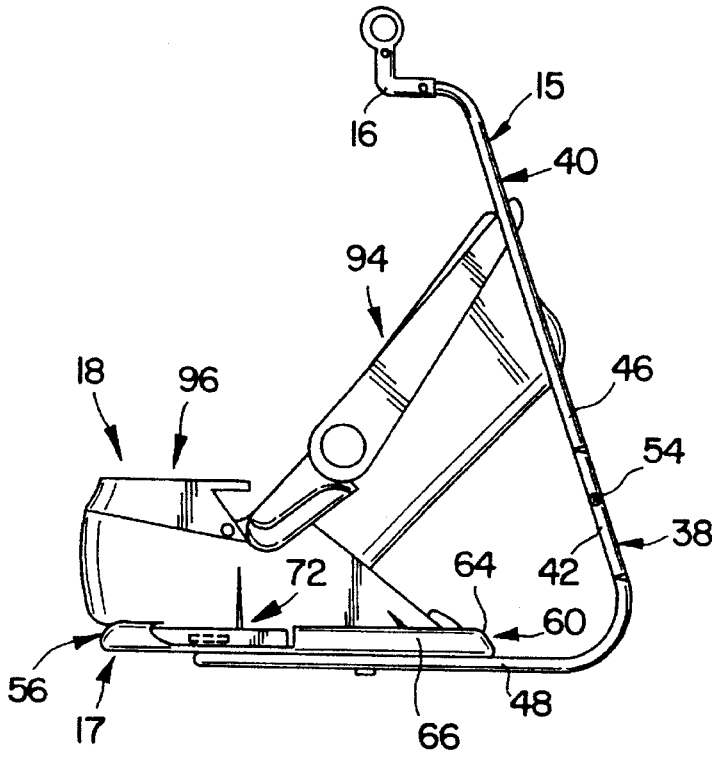
FIG. 5 is a side elevation view of the child seat of FIG. 1 shown in a mounted forward-facing position on the pivotable base and arranged in a chair configuration for swinging movement along a swing arc in forward and rearward swing directions.
Figure 6:
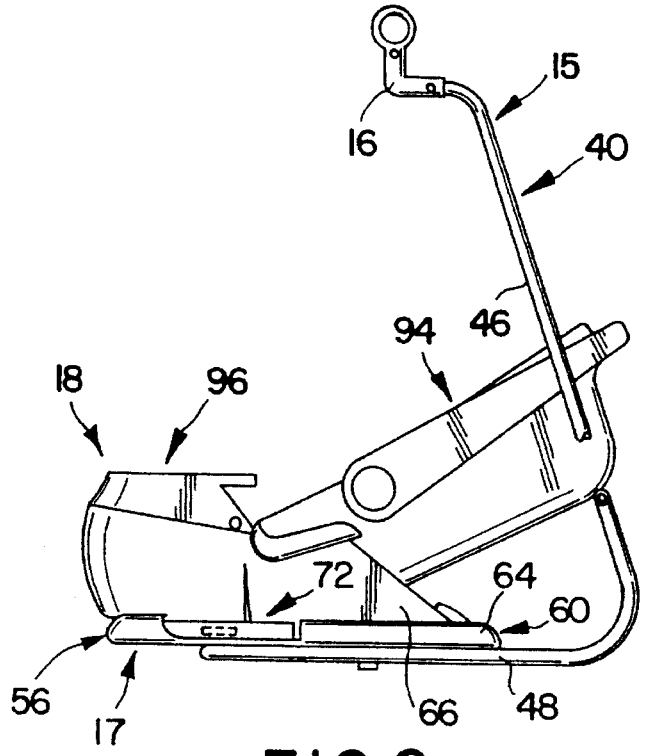
FIG. 6 is a view similar to FIG. 5 showing engagement of a back edge of the upper shell portion of the child seat on a transverse cross member provided in the swing frame to block movement of the upper shell portion of the child seat to a cradle configuration lying in substantially planar alignment with the lower shell portion as long as the pivotable base is arranged in its forward-facing position.

A base cross bar 52 interconnects lower portions 44, 48 of first and second side arms 38, 40 as shown in FIG. 2 to provide a foundation for pivotable base 17. As shown in FIGS. 1 and 6, a rear cross bar 54 interconnects midsections of upper portions 42, 46, of first and second side arms 38, 40 to provide a backstop for blocking conversion of child seat 10 from a chair configuration shown in FIGS. 1 and 5 to a cradle configuration shown in FIG. 10.

Illustratively, swing frame 15 is made of a single metal tubular member that is bent to provide first and second side arms 38, 40 and bight portion 50. Swing frame 15 also includes two straight metal tubular members that are mounted in place to define base cross member 52 and rear cross member 54.

Base 17 includes a platform 56 having a central seat-receiving surface 58 and a slightly raised side rim 60 extending around left edge 62, back edge 64, and right edge 66 of base 17. Front edge 68 of base 17 is open as shown in FIG. 1. Base 17 is also formed to include a first recessed area 69 in left edge 62 for receiving a first latch assembly 70 and a second recessed area 71 in right edge 66 for receiving a second latch assembly 72 as shown in FIG. 2. Left edge 62 is also formed to include a first fixture-receiving slot 74 interconnecting recessed area 69 and seat-receiving surface 58 and right edge 66 is also formed to include a second fixture-receiving slot 76 interconnecting recessed area 71 and seat-receiving surface 58 as shown, for example, in FIGS. 1, 2, and 7.

Figure 4:
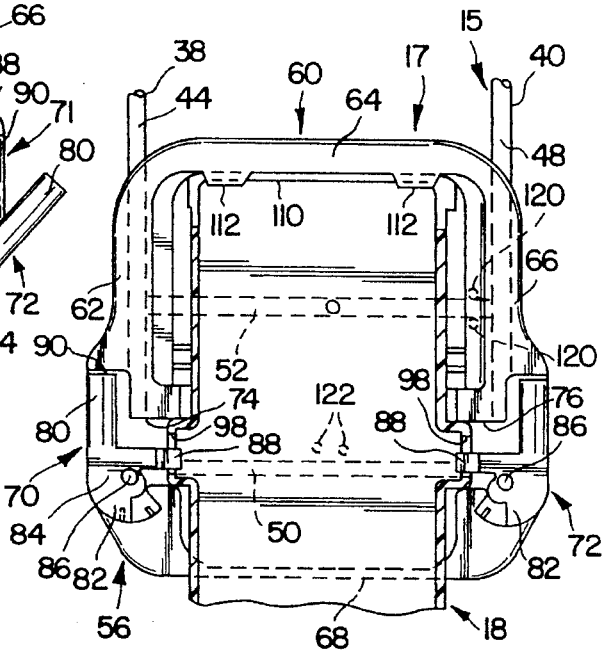
FIG. 4 is a view similar to FIG. 2 showing pivoted movement of each of the latch assemblies to a latching position in which a locking lug on each latch assembly fits into a lug-receiving slot formed on each of the sides of the car seat to retain the child seat in a fixed forward-facing position on the base.

Each of the latch assemblies 70 and 72 include an elongated latch arm 78 having a grip handle 80 at one end, a stop member 82 at an opposite end, and a pivot mount 84 positioned therebetween as shown in FIG. 2. Pivot mount 84 is formed to include an aperture for receiving an upright pivot post 86 that is coupled to base 17. Each latch assembly 70 and 72 further includes a locking lug 88 arranged to lie at a right angle to grip handle 80 and lie at least partly in one of the fixture-receiving slots 74, 76. Essentially, each latching assembly is pivotable about its pivot post 86 from a child seat-releasing position shown in FIG. 2 to a child seat-engaging position shown in FIG. 4. A detent such as detent 90 is appended to pivotable base 17 to engage and block movement of the latch assembly 70 or 72 away from its child seat-engaging position as shown in FIG. 4. Rotation of each of the latch assemblies 70, 72 in an outward direction away from engagement with child seat 18 is limited by engagement of stop member 82 on a portion of side rim 60 as shown, for example, in FIG. 2.

Figure 3:
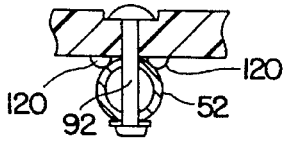
FIG. 3 is a view taken along line 3—3 of FIG. 2 showing a vertical pivot post mounted on an underlying cross bar included in the swing frame to support the base for pivotable movement relative to the swing frame.

As shown in FIGS. 2 and 3, a pivot post 92 is coupled to a midsection of base cross member 52 and arranged to extend upwardly in a vertical direction to engage pivotable base 17 and establish a pivoting joint for base 17 relative to swing frame 15. As shown in FIG. 3, pivot post 92 is defined by a sturdy rivet. As shown in FIG. 2, pivot post 92 is not mounted to engage the center of pivotable base 17 and instead is mounted in a position so as to be offset from the center of mass of the pivotable base 17 and the child seat 18 mounted thereon. Illustratively, the pivotable base 17 is rotatable manually by a caregiver from a forward-facing position wherein front edge 68 is presented to move between front legs 24 and 25 of support stand 12 as shown in FIGS. 1 and 2 to a side-facing position wherein front edge 68 is positioned to face between front leg 25 and rear leg 27 as shown for example in FIGS. 8–10.

Child seat 18 preferably includes a shell assembly having upper and lower shell portions 94, 96 pivotably coupled together as shown in FIG. 1. The upper shell portion 94 can be positioned in either a first angular orientation with respect to lower shell portion 96 as shown in FIGS. 1, 5, and 9 or in a second generally planar orientation as shown in FIG. 10. In the first angular orientation, the child seat 18 is configured to provide a traditional chair configuration. In the second generally planar orientation, child seat 18 provides a cradle configuration. Reference is made to U.S. Pat. No. 4,998,307 to Richard E. Cone, which patent is incorporated by reference herein, for a description of a suitable convertible infant restraint device for use as child seat 18. One feature of child seat 18 is that it includes a generally rigid shell which has an upper and lower portion that are pivotably coupled so that the shell can be positioned in either a planar configuration or an angled configuration. One advantage of this structure is that child seat 18 can be used in a position mounted on base 17 as a chair as shown in FIGS. 5 and 9 or as a cradle as shown in FIG. 10. Also, if child seat 18 is removed from its mounted position on base 17 it can be used as a car bed for small infants, a standard rear-facing car seat for older infants, or an infant carrying device. Caregivers will appreciate the versatility and flexibility that convertible child swing offers.

In use, a caregiver can mount child seat 18 on pivotable base 17 in the manner shown in FIGS. 1, 2, and 4. First, latch assemblies 70, 72 are swung outwardly away from one another to the position shown in FIG. 1 to make base 17 ready for receiving child seat 18. As shown in FIGS. 1 and 2, lower shell portion 96 of child seat 18 includes an outwardly protruding mounting fixture 97 formed to include a lug-receiving slot 98. The bottom of lower shell portion 96 is mounted on seat-receiving portion 58 in base 17 so that a rear lip 110 on lower shell portion 96 engages rear edge 64 of side rim 60 and fits underneath two retention flanges 112 mounted on rear edge 64 as shown in FIGS. 1, 2, and 4. The mounting fixture 97 provided on the left side of lower shell portion 96 fits into the first fixture-receiving slot 74 formed on left edge 62 of side rim 60 as shown in FIG. 2. Likewise, the mounting fixture 97 provided on the right side of lower shell portion 96 fits into the second fixture-receiving slot 76 formed on the right edge 66 of side rim 60 as also shown in FIG. 2. Thus, retention flanges 112 and the positioning of mounting fixtures 97 in fixture-receiving slots 74, 76 formed in base 17 help to locate and position child seat 18 in a predictable predetermined position on base 17.

Once child seat 18 is properly positioned on underlying base 17, the caregiver manually rotates latch 70 in direction 114 and latch assembly 72 in direction 116 to cause locking lugs 88 on latch assemblies 70, 72 to fit into the lug-receiving slots 98 formed in mounting fixtures 97 as shown in FIG. 4. Such engagement functions to anchor child seat 18 in place on pivotable base 17. Detents 90 engage latch assemblies 70 and 72 to help hold latch assemblies in their child seat-retaining positions shown in FIG. 4.

Once child seat 18 is properly installed on pivotable base 17 as shown in FIGS. 4 and 5, it will typically be arranged to lie in a forward-facing position as shown in FIGS. 4 and 5. As shown in FIG. 5, child seat 18 has been positioned by the caregiver to assume its chair configuration. In such a configuration, upper shell portion 94 is arranged to lie at an angle with respect to the lower shell portion 96 mounted on pivotable base 17. It is not recommended that child seat 18 be arranged to lie in its cradle position when pivotable base 17 occupies its forward-facing position as shown in FIGS. 1, 2, 4, and 5. Therefore, a rear cross member 54 is positioned as shown in FIGS. 1 and 6 to interconnect upper portions 42, 46 of first and second side arms 38, 40. This rear cross member 54 is placed at a predetermined elevation above pivotable base 17 to block movement of upper shell 94 so that upper shell 94 does not move to a position below the position of upper shell 94 shown in FIG. 6. This position of rear cross member 54 is selected to minimize breathing difficulties of children seated in child seat 18 during swinging of swing frame 15 along a swing arc in forward and rearward swinging directions.

If a caregiver chooses to convert child swing 10 from a chair-style swing to a cradle-style swing, it is necessary only to pivot base 17 about pivot post 92 from the forward-facing position on swing frame 15 shown in FIG. 2 to the side-facing position of base 17 shown in FIG. 8. As such, base 17 is pivoted about pivot post 92 through a 90° angle from the position shown in FIG. 4 to the position shown in FIG. 7 and then to the final position shown in FIG. 8. As shown in FIGS. 4, 7, and 8, the unit is designed so that the center of mass 118 of the base 17 in combination with child seat 18 is offset from the pivot post 92. Such an offset enhances the stability of child swing 10 during swinging motion of child seat 18 on base 17.

Once the caregiver has pivoted base 17 to the side-facing position shown in FIG. 8, it is expected that the caregiver will convert child seat 18 from the chair configuration shown in FIG. 9 to the cradle configuration shown in FIG. 10. It will be understood that child seat 18 is able to swing along the swing arc when it occupies the position shown in FIG. 9.

Illustratively, a first set of detents 120 is mounted to the underside of pivotable base 120 to lock the base to swing frame 15 in the forward-facing position shown in FIGS. 2 and 4. Also, a second set of detents 122 is mounted at another position on the underside of base 17 to lock base 17 to frame 15 in its side-facing position as shown in FIG. 8. Illustratively, the first set of detents 120 can be a pair of dimples shown in FIGS. 2 and 3 for engaging and trapping base cross bar 52 therebetween as shown in FIGS. 2 and 3. Likewise, the second set of detents 122 can be a similar pair of dimples for engaging and trapping base cross bar 52 therebetween as shown in FIG. 8.

If a consumer decides to take a child for a trip in a vehicle rather than place the child in child swing 10, it is necessary only to remove child seat 18 from its mounted position on base 17. This is accomplished by swinging latch assemblies 70 and 72 so that locking lugs 88 disengage the lug-receiving slots 98 formed in lower shell portion 96 of child seat 18. The consumer can then lift child seat 18 away from base and use it as a car seat, car bed, or other infant carrier or seat.

Although the invention has been described in detail with reference to a preferred embodiment, variations and modifications exist within the scope and spirit of the invention as described and defined in the following claims.

We claim:

1. A child swing comprising a support stand, a swing frame mounted on the support stand for reciprocating swinging movement along a swing arc in a forward swing direction and an opposite rearward swing direction, a base pivotably coupled to the swing frame for angular movement about a pivot axis between a forward-facing position facing in the forward swing direction and a side-facing position facing in a side direction extending at an angle to the forward swing direction, and a child seat coupled to the base to pivot therewith relative to the swing frame.

2. The child swing of claim 1, wherein the support stand includes a swing motor housing, first and second forward legs coupled to the swing motor housing and arranged to extend downwardly from the swing motor housing in the forward swing direction and lie in spaced-apart relation to define a forward-facing opening therebetween and first and second rearward legs coupled to the swing motor housing and arranged to extend downwardly from the swing motor housing in the rearward swing direction and lie in spaced-apart relation to define a rearward facing opening therebetween, the first forward leg lies in spaced-apart relation to the first rearward leg to define a first A-shaped side-facing opening therebetween on one side of the support stand, the second forward leg lies in spaced-apart relation to the second rearward leg to define a second A-shaped side facing opening therebetween on an opposite side of the support stand, the child seat includes a headrest portion and a footrest portion, and the child seat is mounted in a fixed position on the base to cause the headrest portion to lie adjacent to the rearward-facing opening and footrest portion to lie adjacent to the forward-facing opening upon pivoting movement of the base on the swing frame to its forward-facing position and to cause the headrest portion to lie adjacent to the first A-shaped side-facing opening and footrest portion to lie adjacent to the second A-shaped side-facing opening upon pivoting movement of the base on the swing frame to its side-facing position.

3. The child swing of claim 2, wherein the angle between the forward swing direction and the side direction is 90°.

4. The child swing of claim 2, wherein the swing frame includes a first swing arm having an upper portion coupled to the swing motor housing and a lower portion positioned underneath the base, and a cross bar lying underneath the base and interconnecting the lower portions of the first and second swing arms, a pivot post is mounted on the cross bar, and the base is mounted on the pivot post for pivotable movement between the forward-facing and side-facing positions.

5. The child swing of claim 4, wherein the base includes a first detent positioned to engage the cross bar and releasably lock the base to the swing frame for swinging movement therewith upon pivoting movement of the base to the forward-facing position and a second detent positioned to engage the cross bar and releasably lock the base to the swing frame for swinging movement therewith upon pivoting movement of the base to the side-facing position.

6. The child swing of claim 2, wherein the child seat includes a generally rigid shell assembly for receiving a child, the shell assembly includes a lower shell portion and an upper shell portion pivotably coupled to the lower shell portion to permit the shell assembly to be alternately positioned in one of a substantially planar configuration and an angled configuration, and the lower shell portion is releasably coupled to the base to permit movement of the upper shell portion relative to the base.

7. The child swing of claim 6, wherein the swing frame includes a first swing arm having an upper portion coupled to the swing motor housing and a lower portion positioned underneath the base, a second swing arm having an upper portion coupled to the swing motor housing and a lower portion positioned underneath the base, and a cross bar interconnecting the upper portions of the first and second swing arms and engaging the upper shell during movement of the upper shell portion relative to the lower shell portion to block movement of the shell assembly to the substantially planar configuration when the base lies in its forward-facing position.

8. The child swing of claim 7, wherein the swing frame further includes a base cross bar lying underneath the base and interconnecting the lower portions of the first and second swing arms, a pivot post is mounted on the base cross bar, and the base is mounted on the pivot post for pivotable movement between the forward-facing and the side-facing positions.

9. The child swing of claim 7, wherein the base includes a top side facing toward the swing motor housing, the lower shell portion of the shell assembly is releasably coupled to the top side of the base, and the upper shell portion is movable relative to the lower shell portion to engage the top side of the base upon pivoting movement of the base to the side-facing position so that the shell assembly is movable to assume the substantially planar configuration on the base during swinging movement of the base in the side-facing position with the swing frame along the swing arc.

10. The child swing of claim 1, wherein the base includes a platform supporting the child seat and a latch assembly coupled to the platform for movement between a latching position engaging the child seat to retain the child seat on the platform and a releasing position disengaging the child seat to release the child seat form the platform.

11. The child swing of claim 10, wherein the platform includes a detent positioned to engage the latch assembly and releasably lock the latch assembly in its latching position during swinging movement of the base with the swing frame.

12. The child swing of claim 10, wherein the latch assembly includes a pivot post appended to the platform and a latch arm having a grip handle and a locking lug, the child seat is formed to include a lug-receiving slot, and the latch arm is mounted on the pivot post appended to the platform for pivotable movement so that the locking lug engages the lug-receiving slot upon movement of the latch assembly to the latching position and disengages the lug-receiving slot upon movement of the latching assembly to the releasing position.

13. The child swing of claim 12, wherein the platform includes a seat-receiving surface and a side rim adjacent to the seat-receiving surface, the side rim is formed to include a fixture-receiving slot, the child seat includes a base engaging the seat-receiving surface and a mounting fixture appended to the base and positioned to extend into the fixture-receiving slot upon engagement of the base of the child seat and the seat-receiving surface on the platform to align the child seat in a predetermined position on the platform.

14. The child swing of claim 13, wherein the mounting fixture is formed to include the lug-receiving slot and the locking lug is arranged to pass through the fixture-receiving slot formed in the side rim and engage the lug-receiving slot formed in the mounting fixture upon movement of the latch assembly to the latching position.

15. The child swing of claim 10, wherein the child seat includes a generally rigid shell assembly for receiving a child, the shell assembly includes a lower shell portion and an upper shell portion pivotably coupled to the lower shell portion to permit the shell assembly to be alternately positioned in one of a substantially planar configuration and an angled configuration, the latch assembly includes a locking lug, and the lower portion is formed to include a lug-receiving slot positioned to receive the locking lug therein upon movement of the latch assembly to its latching position to retain the lower shell portion in a fixed position on the platform and allow pivoting movement of the upper portion relative to the lower shell portion and the platform.

16. The child swing of claim 15, wherein the latch assembly further includes a pivot post appended to the platform and a latch arm carrying the locking lug and the latch arm is mounted on the pivot post appended to the platform for pivotable movement so that the locking lug engages the lug-receiving slot formed in the lower shell portion upon movement of the latch assembly to the latching position.

17. The child swing of claim 16, wherein the swing frame includes a first swing arm having an upper portion coupled to the swing motor housing and a lower portion positioned underneath the base, a second swing arm having an upper portion coupled to the swing motor housing and a lower portion positioned underneath the base, and a cross bar interconnecting the upper portions of the first and second swing arms and engaging the upper shell during movement of the upper shell portion relative to the lower shell portion to block movement of the shell assembly to the substantially planar configuration when the base lies in its forward-facing position.

18. The child swing of claim 17, wherein the swing frame further includes a base cross bar lying underneath the base and interconnecting the lower portions of the first and second swing arms, a pivot post is mounted on the base cross bar, and the base is mounted on the pivot post for pivotable movement between the forward-facing and the side-facing positions.

19. The child swing of claim 17, wherein the base includes a top side facing toward the swing motor housing, the lower shell portion of the shell assembly is releasably coupled to the top side of the base, and the upper shell portion is movable relative to the lower shell portion to engage the top side of the base upon pivoting movement of the base to the side-facing position so that the shell assembly is movable to assume the substantially planar configuration on the base during swinging movement of the base in the side-facing position with the swing frame along the swing arc.

* * * * *

US005562548C1

(12) EX PARTE REEXAMINATION CERTIFICATE (9494th)

United States Patent
Pinch et al.

(10) Number: US 5,562,548 C1
(45) Certificate Issued: Jan. 25, 2013

(54) CONVERTIBLE CHILD SWING

(75) Inventors: Daniel R. Pinch, Hope, IN (US); Dennis M. Turner, Scipio, IN (US)

(73) Assignee: Mattel, Inc., El Segundo, CA (US)

Reexamination Request:
No. 90/011,860, Aug. 16, 2011

Reexamination Certificate for:

| | |
|---|---|
| Patent No.: | **5,562,548** |
| Issued: | **Oct. 8, 1996** |
| Appl. No.: | **08/334,597** |
| Filed: | **Nov. 4, 1994** |

(51) Int. Cl.
*A63G 9/16* (2006.01)

(52) U.S. Cl. ..... 472/119; 472/118; 297/256.12; 297/256.16; 297/344.21

(58) Field of Classification Search ..... None
See application file for complete search history.

(56) References Cited

To view the complete listing of prior art documents cited during the proceeding for Reexamination Control Number 90/011,860, please refer to the USPTO's public Patent Application Information Retrieval (PAIR) system under the Display References tab.

*Primary Examiner* — William Doerrler

(57) ABSTRACT

A child swing including a support stand, a swing frame mounted on the support stand for reciprocating swinging movement along a swing arc in a forward swing direction and an opposite rearward swing direction, a base pivotably coupled to the swing frame for angular movement about a pivot axis between a forward-facing position facing in the forward swing direction and a side-facing position facing in a side direction extending at an angle to the forward swing direction, and a child seat coupled to the base to pivot therewith relative to the swing frame.

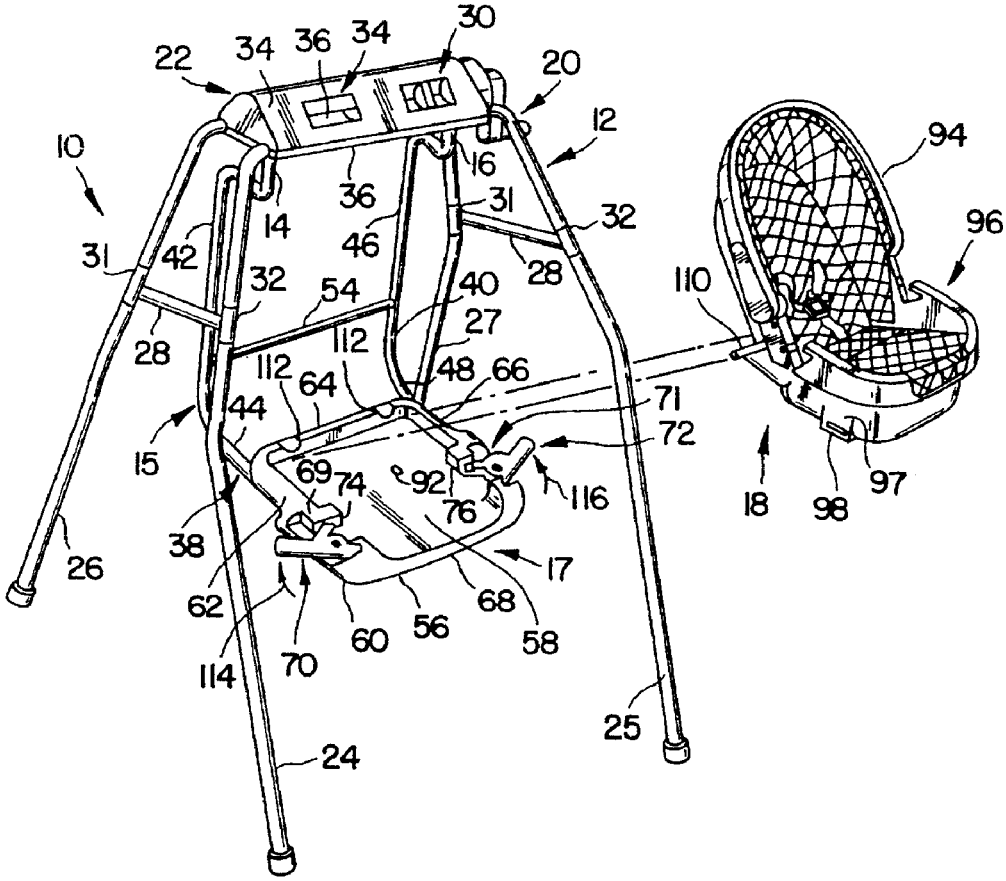

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-4, 6, 10, 12, 13, 15 and 16 is confirmed.

New claims 20-25 are added and determined to be patentable.

Claims 5, 7, 8, 9, 11, 14 and 17-19 were not reexamined.

*20. The child swing of claim 1, wherein:*

*the support stand comprises:*

*a motor housing including a motor, and*

*at least one leg configured to support the motor; and*

*the swing frame includes a hanger arm driven by the motor to impart the reciprocating swinging movement to the swing frame.*

*21. The child swing of claim 1, wherein the swing frame comprises a hanger arm driven by a motor, the hanger arm extending to a position below the seat.*

*22. The child swing of claim 1, wherein the child seat comprises first seat portion and a second seat portion pivotally coupled to the first seat portion.*

*23. The child swing of claim 1 further including a detent operable to secure the position of the child seat relative to the swing frame.*

*24. The child swing of claim 1, wherein the angle between the forward swing direction and the side direction is 90°.*

*25. The child swing of claim 1, wherein the swing further includes a latch assembly operable in a latching position, in which the latch assembly retains the child seat on the base, and in a releasing position, in which the latch assembly releases the child seat from the base.*

* * * * *